US008740666B1

(12) United States Patent
Slusher

(10) Patent No.: US 8,740,666 B1
(45) Date of Patent: Jun. 3, 2014

(54) APPAREL ACCESSORY AND SECURING METHOD

(71) Applicant: Judith Ann Slusher, Harpers Ferry, WV (US)

(72) Inventor: Judith Ann Slusher, Harpers Ferry, WV (US)

( * ) Notice: Subject to any disclaimer, the term of this patent is extended or adjusted under 35 U.S.C. 154(b) by 0 days.

(21) Appl. No.: 13/998,346

(22) Filed: Oct. 23, 2013

Related U.S. Application Data

(60) Provisional application No. 61/735,151, filed on Dec. 10, 2012.

(51) Int. Cl.
*A41C 3/00* (2006.01)
*A41F 15/02* (2006.01)

(52) U.S. Cl.
USPC ..... 450/86; 2/336; 24/66.11; 24/66.5; 24/706.4; 24/706.6

(58) Field of Classification Search
USPC ..... 2/459, 460, 461, 336, 337, 265, 269, 2/270, 271; 24/709.6, 711.3, 66.11, 66.5, 24/66.6, 357, 706.4, 707.7, 706.3, 706.5, 24/707, 707.2, 707.4, 707.8, 707.9, 708.2, 24/709.2, 708.1–708.7, 351, 12, 6, 13, 24/314, 518, 113 MF, 103, 48, 51, 55, 60; 63/20, 1.1; 224/264; 450/86
See application file for complete search history.

(56) References Cited

U.S. PATENT DOCUMENTS

| | | | | |
|---|---|---|---|---|
| 127,353 | A | 5/1872 | Knipfer | |
| 153,575 | A | 7/1874 | Knorpp | |
| 325,117 | A | 8/1885 | Schroder | |
| 349,903 | A * | 9/1886 | Rosado | 24/707.8 |
| 365,853 | A | 7/1887 | Palmer | |
| 1,049,457 | A * | 1/1913 | Courvoisier | 24/707.7 |
| 1,055,568 | A * | 3/1913 | Stransky | 24/706.4 |
| 1,489,731 | A | 4/1924 | Baldwin | |
| 1,783,470 | A * | 12/1930 | Helmbold et al. | 24/707.7 |
| 1,882,242 | A * | 10/1932 | Dailey | 140/71 R |
| 2,562,519 | A * | 7/1951 | Ashley | 2/132 |
| 3,088,295 | A | 5/1963 | Haines | |
| 4,235,356 | A * | 11/1980 | Atchisson | 224/192 |
| 4,839,945 | A * | 6/1989 | Price et al. | 24/66.6 |
| 4,953,233 | A * | 9/1990 | Moshier | 2/268 |
| 5,355,563 | A | 10/1994 | Kanno | |
| 5,441,188 | A | 8/1995 | Rosenstein | |
| 5,787,511 | A * | 8/1998 | Garside | 2/269 |
| 5,836,017 | A | 11/1998 | Hironaga et al. | |
| 5,914,166 | A | 6/1999 | Le | |
| 5,992,176 | A | 11/1999 | Arbogast | |
| 7,725,958 | B1 * | 6/2010 | Gilmore | 2/310 |
| 7,833,085 | B2 * | 11/2010 | Crouch | 450/86 |

(Continued)

*Primary Examiner* — Gloria Hale
(74) *Attorney, Agent, or Firm* — Clifford D. Crowder

(57) ABSTRACT

A method, system, and kit for securing an undergarment strap to an outer garment with a decorative article. The decorative article includes an ornament and first and second stud members extending generally in first and second directions from the ornament and terminating in first and second stud ends. The method includes moving the decorative article in first and second directions to penetrate the surface of the outer garment with the first and second stud members, and continuing to move the decorative article generally in the first and second directions to penetrate the surface of the undergarment strap with the first and second stud members, thereby securing the undergarment strap to the outer garment by the decorative article. The kit includes a container including at least one article of jewelry including first and second stud members, an elongated base member including first and second apertures, and a plurality of protective covers.

20 Claims, 2 Drawing Sheets

(56) References Cited

U.S. PATENT DOCUMENTS

| | | | | |
|---|---|---|---|---|
| 7,959,489 | B2 | 6/2011 | Shaffstall | |
| 8,469,772 | B2 * | 6/2013 | Crouch | 450/86 |
| 2007/0298683 | A1 * | 12/2007 | Shaffstall | 450/86 |
| 2009/0117826 | A1 * | 5/2009 | Crouch | 450/86 |
| 2012/0278974 | A1 | 11/2012 | Lembo James et al. | |
| 2013/0074291 | A1 * | 3/2013 | Ozzard | 24/304 |

* cited by examiner

APPAREL ACCESSORY AND SECURING METHOD

This application claims the benefit of U.S. Provisional Application No. 61/735,151, filed Dec. 10, 2012, the entire contents of which are hereby incorporated by reference.

TECHNICAL FIELD

The present disclosure relates to apparel and, more particularly, to an apparel accessory and a securing method.

BACKGROUND

It is generally recognized that apparel may sometimes serve a functional utilitarian purpose. At other times, apparel may serve a decorative purpose. Indeed, apparel may serve both a functional utilitarian purpose and a decorative purpose at the same time. While exceptions abound, it is safe to say that a large segment of the population prefers that wearing apparel serve the functional utilitarian purpose for which it was designed, while presenting at least a modicum of decorative appearance.

A woman, for example, may often don a brassiere (hereinafter "bra") for its well known utilitarian purpose. She may then don an outer garment, e.g., a blouse, a dress, etc., which may serve a decorative as well as a utilitarian purpose to some extent, and may substantially or completely cover the bra.

Many bras are at least partially secured in the desired position via shoulder straps which pass across the woman's shoulders between a frontal portion of the bra and, for example, a back portion of the bra. At times an outer garment also may include relatively narrow shoulder strap portions that also extends across the woman's shoulders. The strap portions of the outer garment may be intended to completely cover the bra straps so that the bra straps are not visible.

Situations may occur where the strap portion of the outer garment may not adequately cover the bra strap. For example, the strap portion of the outer garment may itself be very narrow and barely cover the bra strap. In such a situation, arm movements may easily dislodge a bra strap that may have been tucked under an outer garment strap. Often it may be highly preferably that the bra strap remains hidden from view beneath the strap portion of the outer garment. It may be desirable for a woman to have a method that is both decorative and utilitarian to securely maintain a bra strap in a position that is substantially hidden from view beneath the outer garment.

Devices and methods for securing a clothing strap are disclosed in U.S. Pat. No. 7,959,489 B2 to Shaffstall ("the '489 patent"). The '489 patent discloses various devices intended to secure a bra strap beneath a strap of an outer garment. The various devices disclosed in the '489 patent include a number of so-called "weavable elements" intended to be interwoven with the straps of the bra and outer garment so as to secure the straps together. The '489 patent also discloses that various adornments may be attached to the weavable elements for aesthetic purposes.

While the devices and methods of the '489 patent may offer a way to secure an underlying bra strap to an overlying strap of an outer garment, this may be achieved only in a manner that may be unduly complicated for the user. For example, the devices disclosed in the '489 patent require that the user manually interweave the disclosed devices with the bra straps and garment straps. In the first instance, placing one of the disclosed devices in proper position may require some significant degree of manual dexterity. Secondly, one of the devices on one side of the user may be inadvertently applied in a way that is unsymmetrical relative to the device employed on the other side. Third, one of the devices may become misaligned relative to the other during use, for example with arm movements. In addition, applying the devices may present a significant challenge for elderly or other persons with arthritic hands.

The disclosed apparel accessory and securing method include improvements in known accessories and methods of the character described.

SUMMARY

In one aspect, a method of securing an undergarment strap to an outer garment with a decorative article is provided. The decorative article includes an ornament, a first stud member extending generally in a first direction from the ornament and terminating in a first stud end, and a second stud member extending generally in a second, opposite direction from the ornament and terminating in a second stud end. The method includes moving the decorative article in a first direction and penetrating the surface of the outer garment with the first stud member. The method also includes continuing to move the decorative article generally in the first direction and penetrating the surface of the undergarment strap with the first stud member. The method additionally includes moving the decorative article in a second direction and penetrating the surface of the outer garment with the second stud member. The method further includes continuing to move the decorative article generally in the second direction and penetrating the surface of the undergarment strap with the second stud member, thereby securing the undergarment strap to the outer garment by the decorative article.

In another aspect, an ornamental article is configured for attaching an outer garment to a bra strap. The article includes an ornament body, a first stud member extending generally in a first direction away from the ornament to a first stud end, and a second stud member extending generally in a second, opposite direction away from the ornament to a second stud end a distance from the first stud end. The article also includes an elongated base member extending to two opposite ends and includes two apertures, one of the two apertures located adjacent each of the two opposite ends, the distance between the two apertures being less than the distance between the first and second stud ends. The first stud member extends through a first one of the apertures, and the second stud member extends through a second one of the apertures. The article also includes a protective cover on each of the first and second stud ends.

In another aspect, a system for securing an undergarment to an outer garment is provided. The system includes an outer garment portion adjacent the shoulder of a wearer of an outer garment. The system further includes an undergarment strap portion adjacent the shoulder of the wearer. The system additionally includes an ornament, a first stud member extending generally in a first direction away from the ornament to a first stud end and penetrating the outer garment portion and the undergarment strap portion, and a second stud member extending generally in a second, opposite direction away from the ornament to a second stud end a distance from the first stud end and penetrating the outer garment portion and the undergarment strap portion. The system further includes a protective cover on each of the first and second stud ends.

In another aspect, a kit for providing a decorative and utilitarian accessory for a garment is provided. The kit includes at least one ornament configured as an article of jewelry and including a first stud member extending generally in a first direction away from the ornament to a first stud end, and a second stud member extending generally in a second, opposite direction away from the ornament to a second stud end at a distance from the first stud end. The kit also includes at least one elongated base member extending to two opposite ends and including two apertures, one of the two apertures located adjacent each of the two opposite ends, the distance between the two apertures being less than the distance between the first stud end and the second stud end. The kit further includes a plurality of protective covers configured to attach to the first and second stud ends of the respective first and second stud members. The kit also includes a container configured to enclose the at least one ornament, the at least one elongated base member, and the plurality of protective covers.

DETAILED DESCRIPTION

Figure 1:
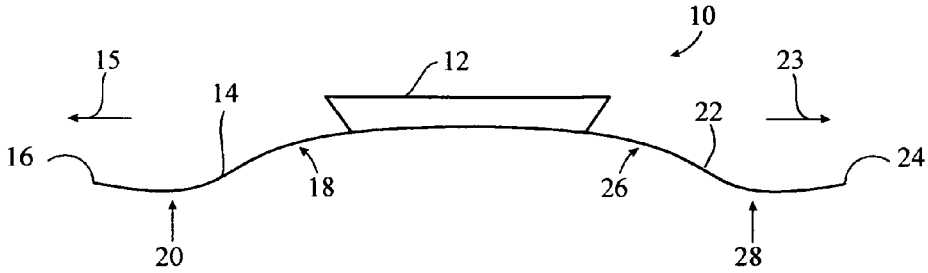
FIG. 1 illustrates a decorative and utilitarian apparel accessory according to a disclosed embodiment.

An exemplary embodiment of a decorative and functional utilitarian apparel accessory 10 is diagrammatically illustrated in FIG. 1, for example. Accessory 10 may include, among other things, an ornament 12. Ornament 12, which is illustrated in a generic and diagrammatic fashion, may include any of a number of decorative components. For example, ornament 12 may be an item of jewelry including one or more gemstones and/or precious metals such as gold or silver. Alternatively, ornament 12 may be a simulated flower, stylized animal figure, or some other representation of an item from nature. Still further, the ornament may be an artistic design, a logo, a letter, or a name, for example.

Ornament 12 may include one or more associated stud members. Referring still to FIG. 1, a first stud member 14 may extend generally in a first direction, indicated by arrow 15, from the ornament 12 and terminate in a stud end 16. First stud member 14 may be gently curved so as to project slightly out of the general plane of the ornament 12. For example, as illustrated, first stud member 14 may include a first curved portion 18 curving and directing the stud member 14 slightly below the ornament in the orientation presented in FIG. 1. First stud member 14 may additionally include a second curved portion 20 curving oppositely to the first curved portion 18 and directing the stud member, as it approaches stud end 16, so that the stud member 14 is only slightly directed out of the general plane of the ornament 12.

Ornament 12 may include a second stud member 22 extending generally in a second direction, indicated by arrow 23, from the ornament 12 and terminating in a stud end 24. The second direction 23 may be opposite to the first direction 15 in which the first stud member 14 extends. In a manner similar to first stud member 14, second stud member 22 may be gently curved so as to project slightly out of the general plane of the ornament 12. Second stud member 22 may include a third curved portion 26 directing the stud member 22 slightly below the ornament in the orientation presented in FIG. 1. Second stud member 22 may additionally include a fourth curved portion 28 curving oppositely to the third curved portion 26 and directing the stud member, as it approaches stud end 24, so that the stud member 22 is only slightly directed out of the general plane of the ornament 12. Accordingly, ornament 12 may include two stud members, for example, each stud member extending and curved slightly out of the general plane of the ornament 12 to form a substantially symmetrical configuration with stud members 14 and 22 extending generally in opposite directions, all as can be seen in FIG. 1.

Figure 2:
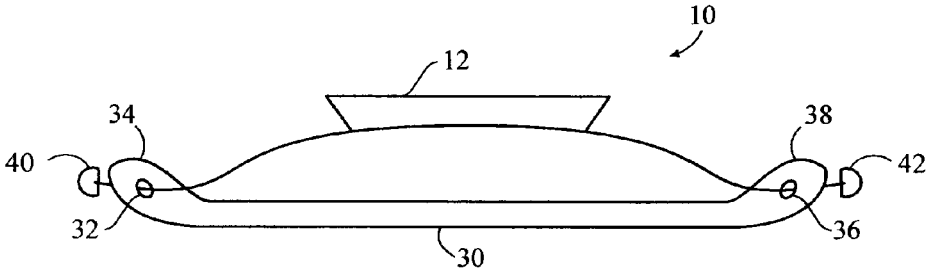
FIG. 2 illustrates another disclosed embodiment of the decorative and utilitarian apparel accessory.

FIG. 2 diagrammatically illustrates an embodiment of the decorative and functional apparel accessory 10 assembled with a base member 30. Base member 30 may be somewhat elongated in one direction and may include a first aperture 32 adjacent a first end 34, and a second aperture 36 adjacent a second end 38. Base member 30 may be generally flat or planar in profile or may be gently curved between its two opposite ends. The two opposite ends of base member 30 may include portions bent at an angle relative to a central portion of the base member, and the apertures adjacent each opposite end of the base member may extend through the portions that are bent at an angle, as generally shown in FIG. 2. Base member 30 may be uniform in width from adjacent end 34 to adjacent end 38, or it may have a greater width toward its center so as to be generally oval in plan view. Apertures 32 and 36 may be of a size sufficient so that a stud member 14 or 22 of ornament 12 may be inserted therein.

Referring still to FIG. 2, stud end 16 of stud member 14 may be provided with a protective cap 40, and stud end 24 of stud member 22 may be provided with a protective cap 42. Protective caps 40 and 42 may, for example, engage the stud members 14 and 22 by friction fit. For example, protective caps 40 and 42 may be formed from a compressible synthetic polymeric material. Any other protective cap structures capable of ensuring that the stud ends 16 and 24 of the respective stud members 14 and 22 remain safely covered during use may be employed by those having skill in the art.

It will be noted, referring to FIG. 2, that the distance between stud ends 16 and 24 (covered by protective caps 40, 42 in FIG. 2 but seen clearly in FIG. 1) is greater than the distance between apertures 32 and 36 of base member 30. Stated differently, the distance between apertures 32 and 36 is less than the distance between stud ends 16 and 24 in order to allow stud members 14 and 22 to engage apertures 32 and 36 and achieve the assembled configuration illustrated in FIG. 2. Protective caps 40, 42 may be larger than apertures 32, 36 to inhibit accidental disassembly once the protective caps 40, 42 have been applied to stud ends 16, 24, respectively.

Figure 3A:
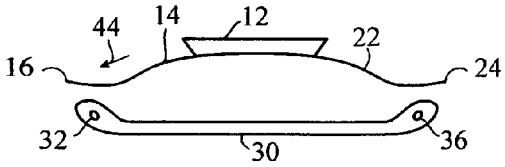
FIGS. 3*a*, 3*b*, and 3*c* diagrammatically illustrate a sequence of assembly of the decorative and utilitarian apparel accessory according to a disclosed embodiment.
Figure 3B:
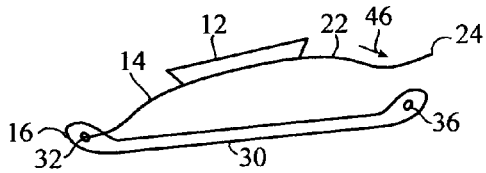
Figure 3C:
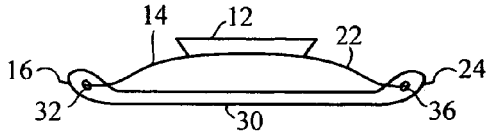

FIGS. 3*a*, 3*b* and 3*c*, for example, diagrammatically illustrate a sequence of events in the assembly of an embodiment of the disclosed decorative and functional utilitarian apparel accessory 10. Referring to FIG. 3*a*, stud end 16 of stud member 14 may be moved relative to base member 30 toward aperture 32 as indicated by arrow 44. Movement in the general direction of arrow 44 may be continued until stud end 16 of stud member 14 has been inserted through aperture 32. A protective cap (e.g., protective cap 40, FIG. 2) may be applied to stud end 16 as soon as it has been inserted through aperture 32.

Referring to FIG. 3*b*, stud end 16 of stud member 14 is illustrated as inserted through aperture 32 of base member 30. At this point stud end 24 of stud member 22 may be moved relative to base member 30 toward aperture 36 as indicated by arrow 46. Movement in the general direction of arrow 46 may be continued until stud end 24 of stud member 22 has been inserted through aperture 36. During this movement, stud member 14 normally will remain inserted through aperture 32 since, as has been stated above, the distance between apertures 32 and 36 is less than the distance between stud end 16 and stud end 24, and also because a protective cap may have been inserted over stud end 16.

Referring now to FIG. 3*c*, both stud end 16 of stud member 14 and stud end 24 of stud member 22 are illustrated as inserted through respective apertures 32 and 36 of base member 30. At the stage of assembly illustrated in FIG. 3*c*, each of stud ends 16 and 24 may project beyond apertures 32 and 36 sufficiently to receive protective caps 40 and 42 (not shown in FIG. 3*c* but seen in FIG. 2), respectively. Where protective cap 40 already may have been applied to stud end 16, protective cap 42 may be applied to stud end 24 at this point. It is contemplated that protective cap 40 may be applied as soon as stud end 24 has been inserted through aperture 32, or both caps 40 and 42 may be applied to stud ends, 16 and 24, respectively, after the assembly has reached the stage illustrated in FIG. 3*c*. While FIGS. 3*a*-3*c* illustrate stud member 14 being applied first, it is contemplated that, instead, stud member 22 may be applied first with stud member 14 following and giving the same result shown in FIG. 3*c*.

Figure 4:
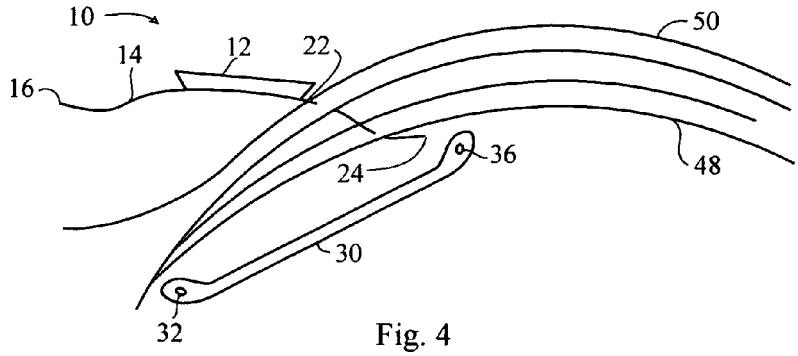
FIG. 4 illustrates a decorative and utilitarian apparel accessory partially assembled and connected to garment portions according to a disclosed embodiment.

FIG. 4 diagrammatically illustrates accessory 10 in a state of partial assembly in connection with a bra strap 48 and an outer garment strap 50. Referring to FIG. 4, it can be seen that stud member 22 has been caused to penetrate first through outer garment strap 50 and then through bra strap 48 and is in a position such that stud end 24 is approaching aperture 36 of base member 30. Stud member 22 then may be inserted through aperture 36. Viewing FIG. 4, and taking the foregoing discussion in connection with FIGS. 3*a*-3*c* of the assembly of accessory 10 into consideration, it can be seen that stud member 14 then may penetrate through outer garment strap 50 and then through bra strap 48 and, subsequently stud end 16 may be inserted through aperture 32 of base member 30.

With both stud members 14, 22 penetrating outer garment strap 50 and bra strap 48 and inserted through apertures 32, 36, respectively, accessory 10 may be considered assembled relative to the outer garment strap 50 and bra strap 48 so as to form a system for securing the bra strap 48 to the outer garment strap 50. As described above, protective caps 40, 42 (FIG. 2) may be applied to the completed assembly. The system thus secures the bra strap 48 beneath the outer garment strap 50 and suitably presents ornament 12 as a decorative accessory while maintaining bra strap 48 securely hidden beneath outer garment strap 50.

Figure 5:
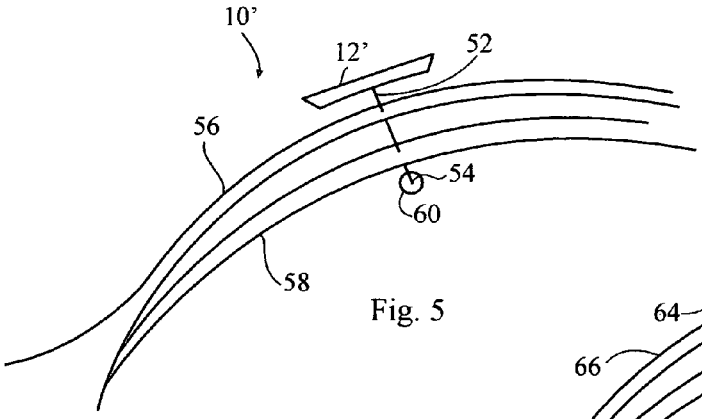
FIG. 5 illustrates another decorative and utilitarian apparel accessory system according to a disclosed embodiment.

FIG. 5 diagrammatically illustrates another disclosed embodiment of a decorative and functional utilitarian accessory system. Referring to FIG. 5, accessory 10', which includes an ornament 12', may include a single stud member 52. In the embodiment illustrated in FIG. 5, stud end 54 of stud member 52 may be inserted first through outer garment strap 56, then through bra strap 58. Stud end 54 may then be covered by protective cap 60. As a result, ornament 12' may be viewed by others while bra strap 58 remains securely hidden from view.

Figure 6:
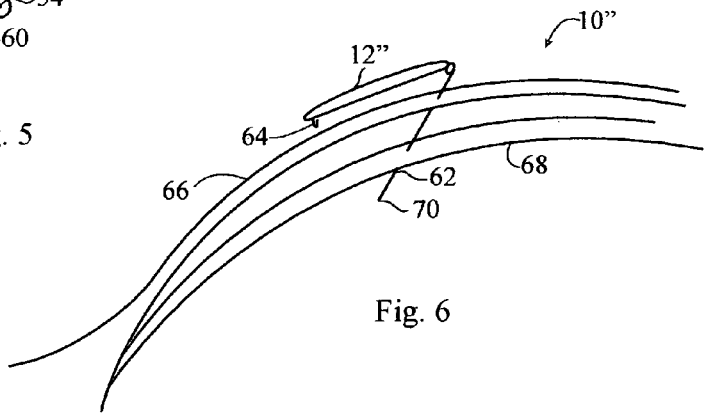
FIG. 6 illustrates a further decorative and utilitarian apparel accessory system according to a disclosed embodiment.

FIG. 6 diagrammatically illustrates yet another embodiment of a decorative and functional utilitarian accessory system. Referring to FIG. 6, accessory 10", which includes ornament 12", may include a pivotable pin 62 that cooperates with a catch member 64. As can be visualized by referring to FIG. 6, pin 62 is first inserted through outer garment strap 66, then through bra strap 68. Subsequently, pin 62 then may be inserted back through bra strap 68 and then back through outer garment strap 66. At this point, end 70 of pin 62 may be engaged with catch member 64. Thus, bra strap 68 may be securely fastened beneath outer garment strap 66 hidden from view, and ornament 12" may be readily visible.

Figure 7:
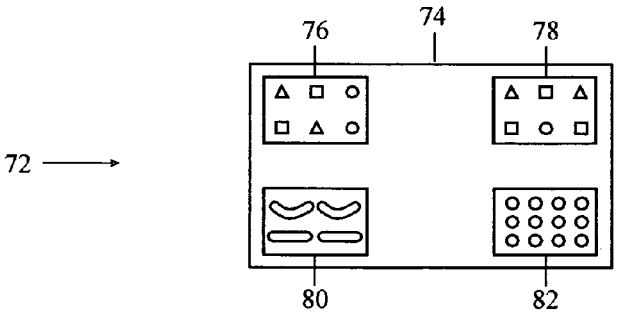
FIG. 7 diagrammatically illustrates a kit according to a disclosed embodiment.

FIG. 7 diagrammatically illustrates a kit 72 that may aid in the implementation of embodiments of the disclosed accessory, method, and system. Kit 72 may include a suitable container 74. Container 74 may take various forms and is only schematically illustrated in FIG. 7. For example, container 74 could be a box, such as a conventional jewelry box suitable for display on a dresser. In an exemplary embodiment, the box may include a hinged lid (not shown) commonly employed for housing items of jewelry. Alternatively, container 74 may be an open container or a container with a separable lid (not shown). In addition, the container may include sections separated by divider (not shown) to keep various components of the kit organized.

In the schematically illustrated embodiment of FIG. 7, the box may include a plurality of compartments 76, 78, 80, and 82, although it will be understood that any suitable number of compartment may be employed. For example, each compartment may be in the form of a depression to house certain components, with individual depressions therein for each individual component. Kit 72 may include one ornament or a plurality of ornaments. For example, kit 72 may include a plurality of ornaments according to the embodiment disclosed in connection with FIG. 1. Some or all of the ornaments may have the same decorative appearance, or each may be uniquely different in appearance.

The kit may include a number of accessories formed in accordance with the embodiment disclosed in FIG. 1. It also may include one or a plurality of base member 30 of various sizes and shapes. In addition, the kit may include accessories according to the embodiments disclosed in FIGS. 5 and 6. Referring to FIG. 7, compartment 76 may house a plurality of ornaments configured generally in the manner described in connection with FIG. 1. Compartment 78 may house a plurality of ornaments configured generally in the manner described in connection with FIGS. 5 and 6. Compartment 80 may include a plurality of base members, along the lines of the embodiment disclosed in FIG. 2, with the base embers being of the same or of differing configuration. Compartment 82 may include a plurality of protective caps similar to those discussed above in connection with FIGS. 2 and 5.

Practical Applicability

The disclosed embodiments of a decorative and functional utilitarian apparel accessory may be employed to securely fasten an undergarment in position beneath an outer garment, and simultaneously, provide a pleasing and decorative outward adornment for the outer garment. For example, a bra strap may be secured beneath a portion of an outer garment that passes over a woman's shoulder. Where an outer garment portion may include a strap of an outer garment, a bra strap may be securely fastened beneath the strap of the outer garment such that the bra strap is held in a relatively fixed position with respect to the outer garment strap and substantially hidden from view.

Referring to FIGS. 3*a*-3*c* and FIG. 4, the disclosed decorative and functional utilitarian apparel accessory 10 may be employed in a method of securing a bra strap to an outer garment strap with a decorative article thereby presenting an outwardly visible decorative and aesthetically pleasing appearance. In the method, the outer garment strap may first be penetrated with a first stud member of the accessory. Then, the bra strap may be penetrated with the first stud member. After that, the outer garment strap may be penetrated with a second stud member, and then the bra strap may be penetrated with the second stud member. After both stud members have been made to penetrate both the outer garment strap and the bra strap, a protective cover may be placed over the ends of each of the first and second stud members. In this assembled position, the bra strap is secured beneath the outer garment strap in position by the accessory, and the bra strap is substantially hidden from view.

In an assembled configuration attached to an outer garment and a bra strap, the resulting combination may be characterized as a system for securing an undergarment to an outer garment. Because stud members 14 and 22 may extend only slightly out of the general plane of the ornament, the accessory may fit closely to an outer garment to which it is attached, presenting a close, neat profile. The system ensures the achievement of both decorative and functional utilitarian goals of the accessory. The disclosed kit provides a convenient, organized expedient for accomplishing the decorative and functional utilitarian aspects of the accessory, and readily enables a variance of adornment depending on the particular garments worn and the occasion for which the garments may be worn.

The various components of the disclosed accessory may be formed of various materials. For example, the ornaments may be articles of jewelry including various gemstones such as diamonds, rubies, sapphires, etc., and may include metallic portions of gold, silver, or other precious metals. The stud members may be formed of plastic, gold, silver, copper, stainless steel, or other relatively rigid materials. The base member may be made of any material such as plastic, metal, ceramic, or composite materials. Additionally, the base member may be made from or covered with a soft material comfortable against a person's skin, or it may have a soft covering, e.g., fabric, adhered to the base member where it may contact the skin. Protective caps may be made of hard polymer material or any other material that may suitably grip the ends of stud members of the accessory.

While embodiments have been disclosed in connection with securing a bra strap in position beneath an outer garment strap, it will be apparent that the disclosed accessories may have other uses. For example, a disclosed accessory may be used to secure undergarment straps other than bra straps beneath straps of an outer garment. A slip garment with shoulder straps, for example may be secured beneath outer garment straps with the disclosed accessory. Situations may arise where a swim suit with shoulder straps may be worn beneath an outer garment with straps. In such a situation, the swim suit strap may be secured beneath the outer garment straps in a manner similar to securing a bra strap. Additionally, the disclosed accessories may be used to simply adorn a garment, such as a dress, shirt, hat, etc. Also, the disclosed accessories may be used simply to secure one garment to another or to secure a scarf or shawl to a garment.

While exemplary embodiments have been disclosed, other embodiments will be apparent to those having ordinary skill in the art from consideration of the specification and practice of the disclosed embodiments. Exemplary embodiments have been schematically illustrated, and the illustrations are not necessarily to scale. Some sizes may be exaggerated to aid illustration and accompanying description, as will be recognized by those having ordinary skill in the art. It is intended that the specification and examples be considered as exemplary only with the true scope of protection being indicated by the following claims.

I claim:

1. A method of securing an undergarment strap to an overlying outer garment with a decorative article, the method comprising:

providing an undergarment having a strap, an outer garment, and a decorative article including an ornament, a first stud member extending generally in a first direction from the ornament and terminating in a first stud end, and a second stud member extending generally in a second, opposite direction from the ornament and terminating in a second stud end;

moving the decorative article in a first direction and penetrating a surface of the outer garment with the first stud member;

continuing to move the decorative article generally in the first direction and penetrating a surface of the undergarment strap with the first stud member;

moving the decorative article in a second direction and penetrating the surface of the outer garment with the second stud member; and continuing to move the decorative article generally in the second direction and penetrating the surface of the undergarment strap with the second stud member, thereby securing the undergarment strap to the outer garment by the decorative article.

2. The method of claim 1, further including:

placing a base member adjacent the undergarment strap, the base member having first and second apertures;

inserting the first stud end of the first stud member through the first aperture in the base member; and inserting the second stud end of the second stud member through the second aperture in the base member.

3. The method of claim 2, further including:

placing a first protective cover over the first stud end of the first stud member; and placing a second protective cover over the second stud end of the second stud member.

4. The method of claim 3, wherein the undergarment is a bra, the undergarment strap is a bra strap, and the outer garment includes a garment strap, and wherein securing the undergarment strap to the outer garment includes securing the bra strap to the garment strap.

5. The method of claim 4, wherein the bra includes first and second bra straps and the outer garment includes left and right garment straps, further including securing the first bra strap to the left garment strap, and securing the second bra strap to the right garment strap.

6. An ornamental article configured for attaching an outer garment to a bra strap, the article comprising:

an ornament;

a first stud member extending generally in a first direction away from the ornament to a first stud end;

a second stud member extending generally in a second, opposite direction away from the ornament to a second stud end a distance from the first stud end;

an elongated base member extending to two opposite ends, each of the two opposite ends including an aperture therein wherein the apertures are spaced a distance less than the distance between the first and second stud ends;

the first stud member removably extending through a first one of the apertures, and the second stud member removably extending through a second one of the apertures; and a protective cover on each of the first and second stud ends.

7. The ornamental article of claim 6, wherein the first stud member includes a first gently curved portion curving away from the ornament, and a second gently curved portion curving oppositely to the first gently curved portion.

8. The ornamental article of claim 7, wherein the second stud member includes a third gently curved portion curving away from the ornament, and a fourth gently curved portion curving oppositely to the third gently curved portion.

9. The ornamental article of claim 8, wherein the two opposite ends of the base member include portions bent at an angle relative to a central portion of the base member, and the apertures adjacent each opposite end of the base member extend through the portions bent at an angle.

10. The ornamental article of claim 9, wherein the ornament includes gemstones, and the stud members include gold.

11. A system for securing an undergarment to an overlying outer garment, the system comprising:

an outer garment having a portion adjacent the shoulder of a wearer of the outer garment;

an undergarment having a strap portion adjacent the shoulder of the wearer and beneath the outer garment portion;

an ornament;

a first stud member extending generally in a first direction away from the ornament to a first stud end for penetrating the outer garment portion and the undergarment strap portion;

a second stud member extending generally in a second, opposite direction away from the ornament to a second stud end a distance from the first stud end for penetrating the outer garment portion and the undergarment strap portion; and a protective cover on each of the first and second stud ends; the system thereby securing the undergarment to the outer garment.

12. The system of claim 11, further including a base member between the wearer and the undergarment strap portion, the base member extending to two opposite ends and including a first aperture adjacent one of the ends and a second aperture adjacent the other of the ends.

13. The system of claim 12, wherein the two opposite ends of the base member include portions bent at an angle relative to a central portion of the base member, and the first and second apertures extend through the portions bent at an angle.

14. The system of claim 12, wherein one of the stud members extends through the first aperture and the second stud member extends through the second aperture.

15. The system of claim 12, wherein the distance between the first aperture and the second aperture is less than the distance between the first stud end and the second stud end.

16. The system of claim 11, wherein the first stud member includes a first gently curved portion curving away from the ornament, and a second gently curved portion curving oppositely to the first gently curved portion.

17. The system of claim 16, wherein the second stud member includes a third gently curved portion curving away from the ornament, and a fourth gently curved portion curving oppositely to the third gently curved portion.

18. A kit for providing a decorative and utilitarian accessory for a garment, the kit comprising:

at least one ornament including a first stud member extending generally in a first direction away from the ornament to a first stud end, and a second stud member extending generally in a second, opposite direction away from the ornament to a second stud end at a distance from the first stud end;

at least one elongated base member extending to two opposite ends and including two apertures, one of the two apertures located adjacent each of the two opposite ends, the distance between the two apertures being less than the distance between the first stud end and the second stud end whereby the first stud end may be inserted through one of the two apertures and the second stud end may be inserted through the other of the two apertures;

a plurality of protective covers configured to attach to the first and second stud ends of the respective first and second stud members whereby the protective covers may be attached to the first and second stud ends; and a container configured to enclose the at least one ornament, the at least one elongated base member, and the plurality of protective covers.

19. The kit of claim 18, wherein the at least one ornament includes a plurality of ornaments each different from the other ornaments in the kit, and wherein the at least one elongated base member includes a plurality of base members.

20. The kit of claim 19, the kit further including at least one additional ornament including a pivotable pin for penetrating fabric and a catch member configured to capture an end of the pin, and the kit also including at least one further ornament including a single stud member for penetrating fabric.

* * * * *